US009754433B2

(12) United States Patent
Lagimodiere et al.

(10) Patent No.: US 9,754,433 B2
(45) Date of Patent: Sep. 5, 2017

(54) REMOTE LOCK SYSTEM

(71) Applicant: Southern Folger Detention Equipment Company, San Antonio, TX (US)

(72) Inventors: Grant Lagimodiere, Ottawa (CA); Robert Adrien Litalien, Gatineau (CA); Michael D. Lockerbie, Saskatoon (CA); Joseph C. Tate, Cibolo, TX (US); Rene Alvarez, Seguin, TX (US); Randy Mortensen, Saskatoon (CA); Ian R. Meier, Saskatoon (CA); Donald G. Halloran, San Antonio, TX (US)

(73) Assignee: Southern Folger Detention Equipment Company, LLC, San Antonio, TX (US)

( * ) Notice: Subject to any disclaimer, the term of this patent is extended or adjusted under 35 U.S.C. 154(b) by 37 days.

(21) Appl. No.: 14/952,045

(22) Filed: Nov. 25, 2015

(65) Prior Publication Data

US 2016/0163140 A1 Jun. 9, 2016

Related U.S. Application Data

(60) Provisional application No. 62/086,958, filed on Dec. 3, 2014.

(51) Int. Cl.
*G07C 9/00* (2006.01)

(52) U.S. Cl.
CPC ..... *G07C 9/00571* (2013.01); *G07C 9/00309* (2013.01); *G07C 9/00904* (2013.01); *G07C 9/00912* (2013.01)

(58) Field of Classification Search
CPC ..... G07C 9/00571; G07C 9/00309; G07C 9/00904; G07C 9/00912
(Continued)

(56) References Cited

U.S. PATENT DOCUMENTS

2012/0002536 A1* 1/2012 Bellur ..... H04L 45/02 370/217
2012/0200387 A1* 8/2012 Hinkel ..... E05B 47/0046 340/5.26
(Continued)

OTHER PUBLICATIONS

PCT International Search Report and Written Opinion released by the U.S. Receiving Office on Feb. 2, 2016 for PCT/US2015/063149, 8 pages.

*Primary Examiner* — Edwin Holloway, III
(74) *Attorney, Agent, or Firm* — Smith Gambrell & Russell LLP

(57) ABSTRACT

A lock system for monitoring and controlling the individual locks on cells in a prison. The lock system has a client component and a server component connected by means of an ethernet network. The server component includes all of the individual locks and the client component includes workstations. The software architecture of the locks includes a hardware layer with an application program interface (API) that controls the sensors and electromechanical components of the lock. The software architecture of the workstations includes a lock configuration tool that communicates with the ethernet network to send commands and to receive data from the locks. The workstations also include a presentation layer or browser that provides the interface with the user of the workstations.

6 Claims, 18 Drawing Sheets

(58) Field of Classification Search
USPC ..... 340/5.7
See application file for complete search history.

(56) References Cited

U.S. PATENT DOCUMENTS

| | | | | |
|---|---|---|---|---|
| 2012/0280783 | A1* | 11/2012 | Gerhardt | G07C 9/00309 340/5.6 |
| 2013/0342314 | A1* | 12/2013 | Chen | G07C 9/00309 340/5.65 |
| 2014/0340196 | A1* | 11/2014 | Myers | G07C 9/00309 340/5.61 |

* cited by examiner

REMOTE LOCK SYSTEM

RELATED APPLICATIONS

This application claims priority from Provisional Patent Application No. 62/086,958 filed on Dec. 3, 2014, which is relied upon and incorporated herein by reference.

FIELD OF INVENTION

This invention relates to a lock system for monitoring and controlling a plurality of locks on cell doors in a prison.

BACKGROUND OF THE INVENTION

The lock system for cell doors in a prison is typically a simple electro-mechanical device that relies on an external programmable logic controller device for control. Such systems suffer poor feedback and diagnostic capabilities. Particularly, such a lock system does not allow a remote command center to monitor the various parameters of each lock in the prison including without limitation whether the lock latch bolt is extended or retracted, whether the lock latch bolt is in transition between extended or retracted, whether the latch bolt is secured, or the temperature of the lock's motor.

Thus, a need exists for a system for remotely monitoring, controlling, and diagnosing a plurality of cell door locks from any location including a central command center.

SUMMARY OF THE INVENTION

A lock system for monitoring and controlling the individual locks on cells in a prison has a client component and a server component connected by means of an ethernet network. The server component includes all of the individual locks and the client component includes workstations, including central command center workstations and mobile workstations.

The software architecture of the locks includes a hardware layer with an application program interface (API) that controls the sensors and electromechanical components of the lock. In addition, the lock API receives and transmits data to a server that is also integral with the lock. The server has an application layer that communicates with the ethernet network using a TCP/IP protocol.

The software architecture of the workstations includes a lock configuration tool that communicates with the ethernet network to receive data from the locks. The workstations also include a presentation layer or browser that provides the interface between the lock system and the users of the workstations. The lock configuration tool provides the monitoring and control functions of the lock system to the individual locks.

Each of the locks has a lock module and lock hardware. The lock module and the lock hardware are powered by power-over-ethernet (POE). A POE subsystem in the lock module separates the data carried by the ethernet from the power component delivered by the ethernet to each individual lock. The lock module includes a processor subsystem and a lock drive subsystem. The processor subsystem receives control signals from the workstations over the ethernet network and controls the operation of the electromechanical components of the lock hardware by means of the lock drive subsystem. Further, the processor subsystem receives sensor inputs from the lock sensors and communicates that sensor information to the workstations.

A separate communication capability for monitoring and controlling an individual lock is provided by a Bluetooth connection between the lock module and a mobile workstation, such as a smart phone, within the range of each of the individual locks.

Other features and advantages of the remote lock system of the present invention use will become apparent to one with skill in the art upon examination of the following drawings and detailed description. It is intended that all such additional features and advantages be included herein within the scope of the present invention.

DETAILED DESCRIPTION OF THE INVENTION

Embodiments of the invention will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figure 1:
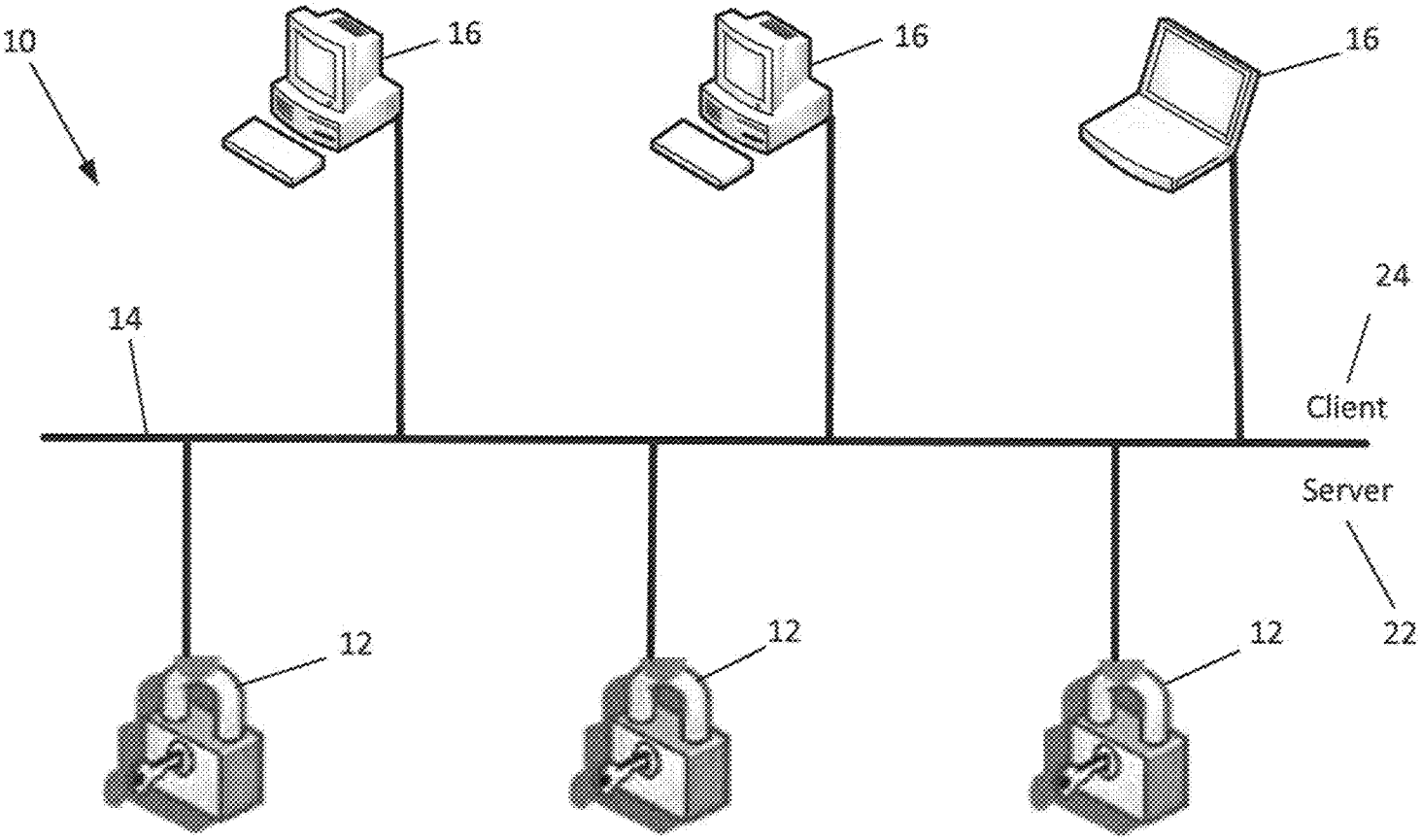
FIG. 1 is a block diagram of a lock system in accordance with the present invention.

Turning to FIG. 1, a remote lock system 10 of the present invention is an IP based lock system that uses a network based application for monitoring and controlling a plurality of locks 12 on cells in a prison. The remote lock system 10 includes the plurality of locks 12 and a plurality of workstations 16. The workstations 16 are connected to the locks 12 by means of an ethernet network 14. The workstations 16 provide command and configuration instructions to the locks 12, and the workstations 16 monitor and display the status of the locks 12, including the configuration of each of the locks 12, the operational status of each of the locks 12, and alarms associated with each of the locks 12. The workstations 16 may include any device that has a browser and can access browser pages on the ethernet network 14. Such devices include, for example, desktop computers, laptops, tablets, and smart phones.

Figure 2:
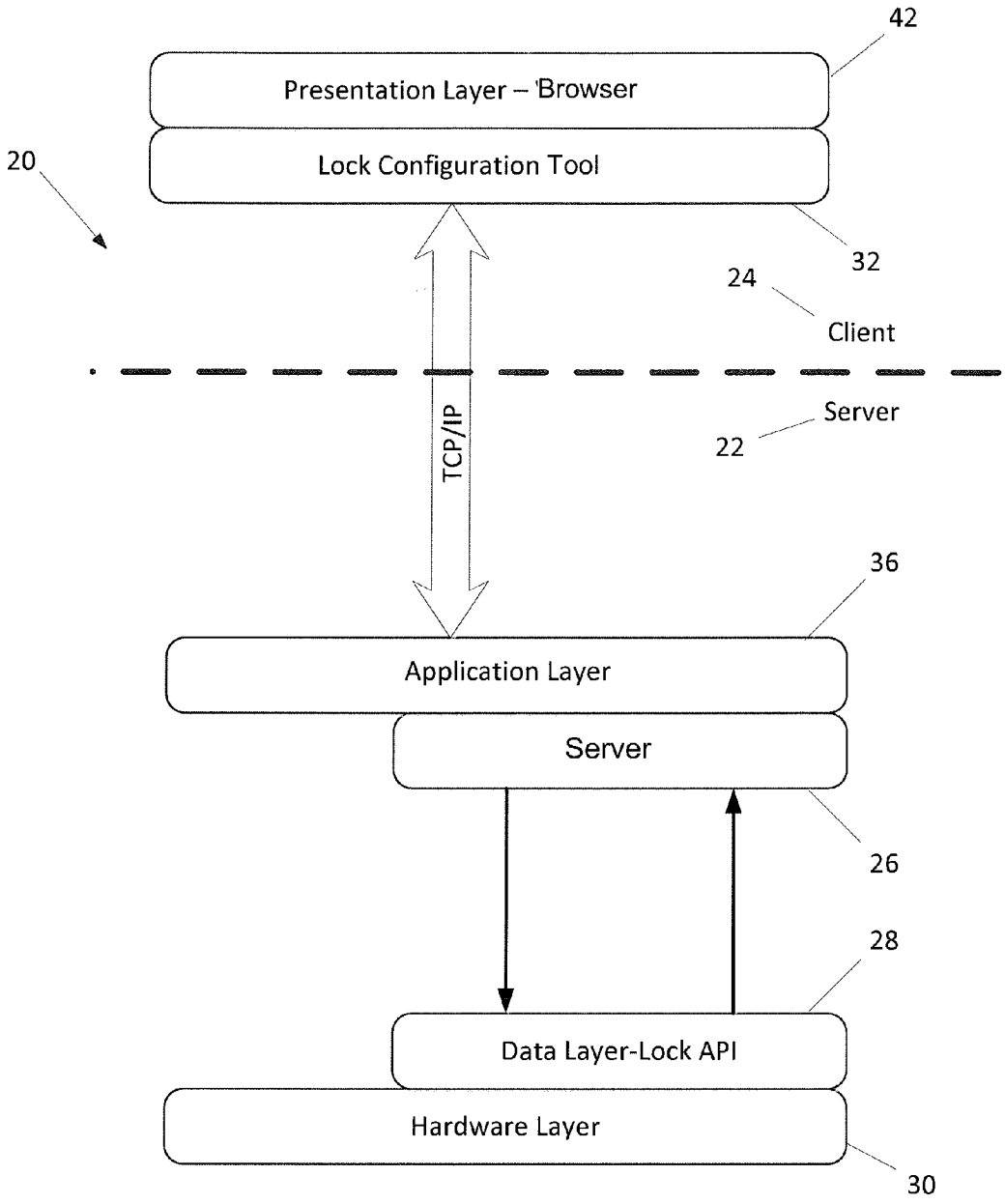
FIG. 2 is a block diagram showing the software architectural structure of the lock system in accordance with the present invention.

FIG. 2 shows the software architecture 20 for the remote lock system 10 including a server component 22, associated with each lock 12, and a client component 24, associated with each of the workstations 16. The server component 22 includes a server 26, a data layer and application program interface (lock API) 28, and a hardware layer 30. The server component 22 generates a browser page with information concerning the attributes of each of the locks 12 and control mechanisms for controlling the operation of each of the locks 12.

The client component 24 includes a lock configuration tool 32 that communicates via the network 14 with the locks 12 and a presentation layer or browser 42 that together with the lock configuration tool 32 provides an interface between the users of the remote lock system 10 and the locks 12. The presentation layer 42 employs a conventional browser to display the various browser pages generated by the server component 22. Each browser page will perform a specific function to configure, control, or view the attributes and status of the locks 12.

In order to access the attributes of one of the locks 12, the server 26 of the lock 12 invokes the lock API 28 to communicate with the lock hardware 40 (FIG. 3) via hardware layer 30 of the server component 22. The lock API 28 sets and retrieves the lock's input and output attributes from the hardware layer 30. An application layer 36 of the server 22 creates a browser page for each of the locks 12 showing the attributes of each particular lock 12.

The lock API 28 is internal to the lock 12 and is not exposed over the ethernet network 14. The lock API 28 passes information between the hardware sensors 34 (FIG. 3) of the lock hardware 40 and the application layer 36, which application layer 36 resides in the lock 12. In addition, the lock API 28 provides a development platform to support and build functionality for the application layer 36 including:

- First-time Commissioning: Initial setup of the lock 12 so it can connect to the network 14.
- Alarms Infrastructure: Provide an alarm management system (reporting, acknowledgement, and clearing of alarms) of all the types of alarms that can be generated by the lock 12.
- Role-Based Security Model: Integrate a user security system required for user authentication and authorization.
- Firmware Upgrade Process: Mechanism to easily upgrade the lock's firmware from the browser 42 associated with the lock configuration tool 32 of the workstations 16.
- Configuration Data (Saving and Loading): Ability to create configuration data files that can be reused by the workstations 16 to configure other locks (data files are loaded onto other locks using the browser 42 as part of the lock configuration tool 32).
- Manage the Server 26 and Services: The application layer 36 ensures robust operation of the server 26 and other services required for the lock configuration tool 32 and an open network video interface forum (ONVIF) support for the presentation layer/browser 42.

The application layer 36 further provides the infrastructure to respond to requests from the lock configuration tool 32 to set the lock configuration elements by using the lock API 28 to set or retrieve set point values or status of the lock 12. The application layer 36 uses the library of the lock API 28 containing the list of calls to access the lock attributes. The main activities performed by the application layer 36 can be summarized as follows:

- Receive requests from the lock configuration tool 32.
- Process the requests and invoke the specific lock API 28 required to retrieve or control lock attributes of each of the locks 12.
- Format, prepare, and send a response back to the lock configuration tool 32 in the form of HTML browser pages or XML-based data.

The lock configuration tool 32 resides in each of the workstations 16 and provides the primary command-and-control for the remote locking system 10. The lock configuration tool 32 integrates contextual information messages with the presentation layer 42 to inform the user of the success or failure of an operation by the lock 12. These messages will take shape as simple icons of varying colors: green for successful operation, orange for a warning (e.g. data missing), or red for a failed operation. Contextual messages will be displayed in a main display area of the browser page.

Figure 3:
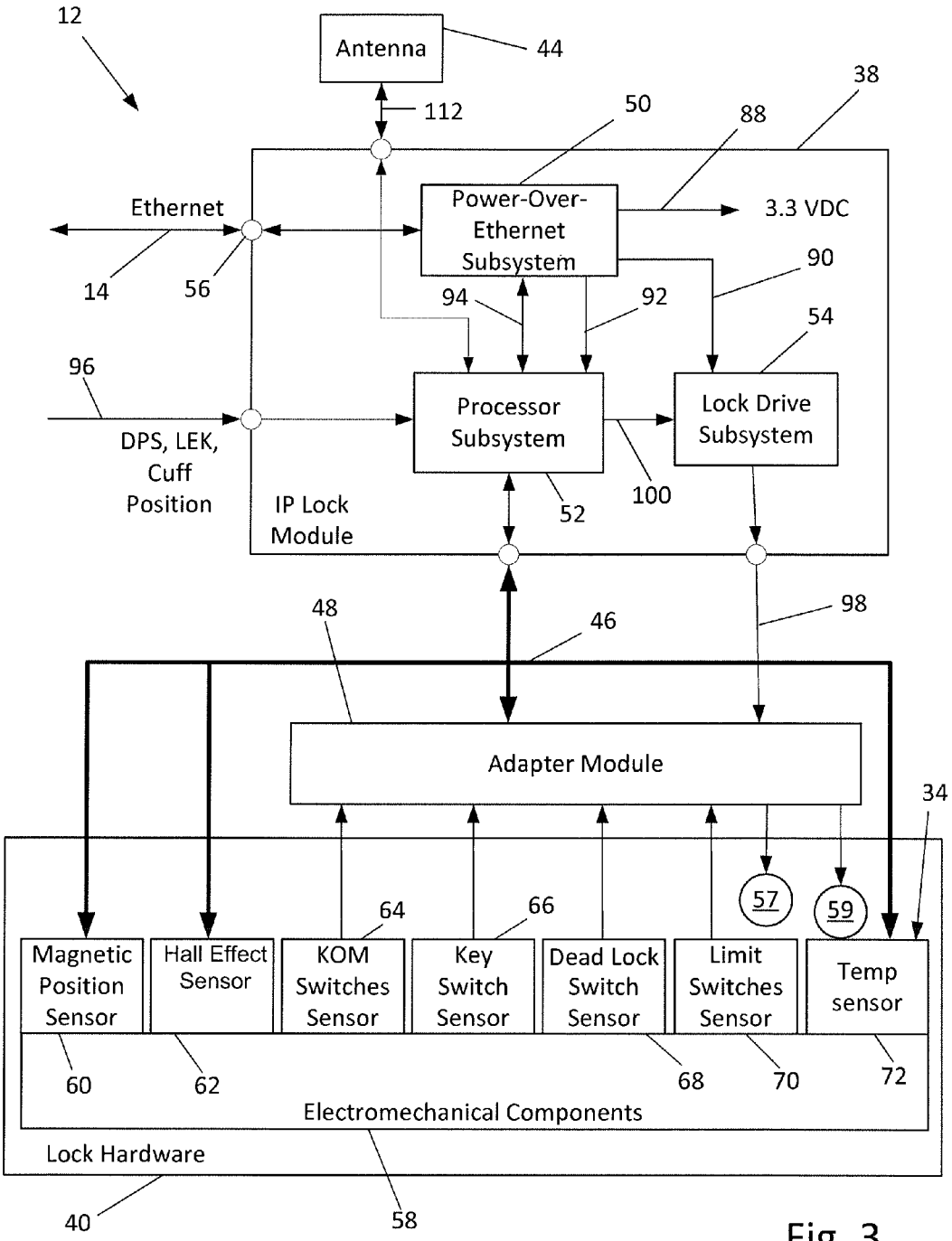
FIG. 3 is a block diagram of the lock for the lock system in accordance with the present invention.

Turning to FIG. 3, the lock 12 comprises the lock hardware 40 including the sensors 34 and the electromechanical components 58 for locking and securing the locks 12, an antenna 44 for Bluetooth communication, an IP lock module 38 that mounts immediately adjacent to the lock hardware 40, an adapter module 48 that accommodates the standard connections of existing lock models, and an interconnect cable 46 that interconnects the IP lock module 38 with the hardware sensors 34 and with the adapter module 48. The electromechanical components 58 include a motor 59 for driving the latch bolt of the locks 12 and an interlock mechanism 57 for securing the latch bolt in its extended and locked position. The lock hardware sensors 34 include a magnetic door position sensor 60, a Hall effect sensor 62, a KOM switch sensor 64, key switch sensor 66, latch bolt switch sensor 68, limit switches sensor 70, and temperature sensor 70.

The magnetic position sensor 60 is a switch that detects whether the cell door is open or closed. The Hall effect sensor 62 detects the position and direction of displacement of the latch bolt of the lock 12. Unlike the binary open/closed signal of a switch, the Hall effect sensor output can vary continuously to describe the path of travel of the latch bolt. The Hall effect sensor monitors the magnetic field surrounding a permanent magnet located on the mechanical latch bolt. The Hall effect sensor 62 converts the sensed magnetic field to a voltage that is measured by the IP lock module 38. Because the latch bolt is constrained to a known travel path, the signal provided by the Hall effect sensor 62 can be characterized in terms of the position of the latch bolt along its path of travel and the direction of travel.

The temperature sensor 72 is located adjacent the motor 59 (FIG. 3) and measures the motor temperature. The output of the temperature sensor 72 is connected through interconnect cable 46 to the IP lock module 38 for monitoring and the setting of an alarm as necessary when an over temperature condition occurs.

With continuing reference to FIG. 3, the Key Override Monitor (KOM) switch sensor 64 is a switch located inside the lock frame and activated by the cylinder cam. The KOM switch indicates when the lock 12 has been opened mechanically by a key. The key switch sensor 66 determines the state of the key switch, namely if the key switch has been activated to override the lock 12. The dead lock switch sensor 68 indicates the position of the dead lock. The limit switch sensor 70 determines the state of the interlock mechanism 57 that secures the latch bolt in the extended, locked position. Lock sensors may further include a local electric key (LEK) switch sensor for determining the status of the local electric key switch, a door position switch (DPS) sensor for determining the location of the cell door, a cuff position switch sensor for determining if the cell door is partially open and therefore in the cuff position. Outputs from such additional sensors are connected to the IP lock module 38 at input 96.

Figure 4:
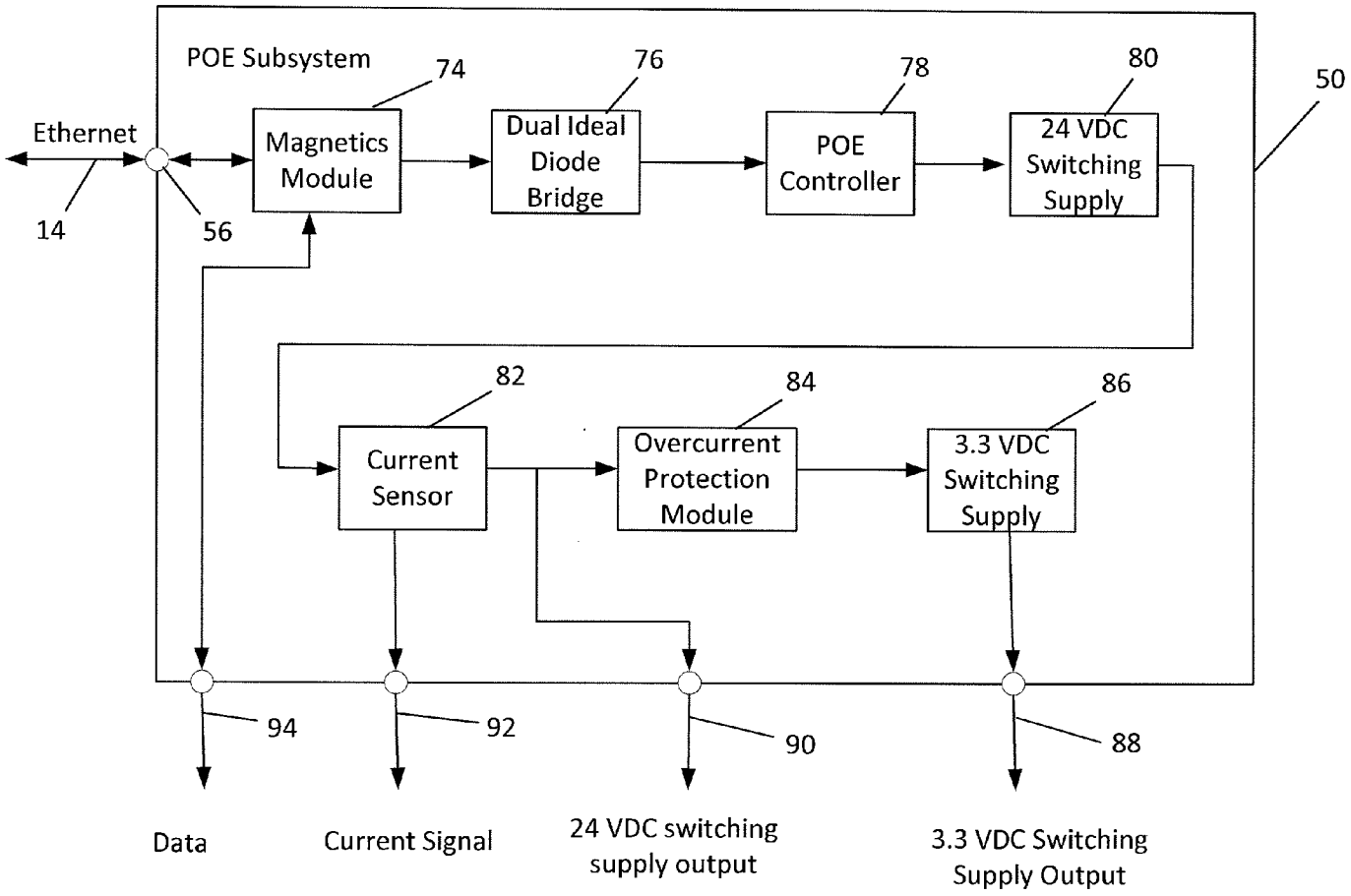
FIG. 4 is a block diagram of a power supply for the lock of the lock system in accordance with the present invention.

The IP lock module 38 monitors the status of the lock hardware 40 and controls the operation of the lock hardware 40 based on instructions from the workstations 16. The IP lock module 38 includes a power-over-internet subsystem (POE subsystem) 50, a processor subsystem 52, and a lock drive subsystem 54. The POE subsystem 50 is illustrated in FIG. 4. Power is distributed to each lock 12 from a centrally located power source (not shown) connected to the ethernet network 14. Power is supplied to the IP lock module 38 from the ethernet network 14 via the ethernet connection 56 to the POE subsystem 50. The POE subsystem 50 converts the power supplied from the ethernet to the voltages required by the electromechanical components 58 of the lock 12 and the logic circuitry of the IP lock module 38. The remote lock system 10 utilizes POE standards, 802.3at++ and HDBaseT extensions, in order to deliver 90 W and 95 W of power respectively to each lock 12. Due to inefficiencies associated with voltage conversion and losses in the cable of ethernet network 14, the maximum power delivered to the locks 12 at the full ethernet range (100 m) is reduced from 90 W to approximately 70 W or 2.9 A at 24 VDC. The 70 W power capacity is sufficient to drive the motor 59 and interlock mechanism 57 of most locks 12 even with the lock's motor 59 in a stalled condition. The 70 W power capacity is also sufficient as long as the electromechanical components 58 the locks 12 are not activated on all of the locks 12 at the same time.

With reference to FIGS. 3 and 4, the POE subsystem 50 includes a magnetics module 74, a dual ideal diode bridge 76, a POE controller 78, a 24 VDC switching supply 80, a current sensor 82, an overcurrent protection molecule 84, and a 3.3 VDC switching supply 86. The signal received from the ethernet network 14 at ethernet connection 56 of the POE subsystem 50 includes both power and data. The magnetics module 74 separates the power component of the ethernet signal from the data component and delivers the data component to the processor subsystem 52 (FIG. 3) via line 94. Four center taps of a quadruple center-tapped transformer in the magnetics module 74 are connected to the dual ideal diode bridge 76. The dual ideal diode bridge 76 comprises two full bridge ideal diode rectifiers. Each bridge in the dual ideal diode bridge 76 takes one pair of the four power signals and rectifies the voltage before feeding the rectified voltage to the POE controller 78. The dual ideal diode bridge 76 is implemented by using MOSFETs (typically two N type and two P type) with the protection diodes arranged in the traditional bridge manner. The POE controller 78 controls the gates of the MOSFET devices of each ideal diode bridge 76, and includes a charge-pump to allow the use of N-MOSFETs exclusively. Using N-MOSFETs exclusively reduces cost, size, and power consumption of the ideal diode bridge 76 as compared with the mixed use of N type and P type MOSFETs. The POE controller 78 negotiates with the central power supply of the ethernet to request delivery of the desired power level and connects the rectified power to the 24 VDC switching supply 80.

The 24 VDC switching supply 80 is connected to the overcurrent protection module 84 through the current sensor 82. The current sensor 82 produces an analog signal on line 92 that is proportional to the current flowing from the 24 VDC switching supply 80. The analog signal on line 92 is connected to the processor subsystem 52 so that the processor subsystem 52 can monitor the current flow from the 24 VDC switching supply 80. The output of the current sensor 82 connects the 24 VDC switching supply 80 the 24 VDC switching supply output 90. The output of the current sensor 82 is also connected to the overcurrent protection module 84. The overcurrent protection module 84 is implemented by a resettable fuse to protect all components except for the lock drive system 54, which is protected by a fuse in the centrally located power source (not shown) that provides power to the ethernet network 14. The output of the overcurrent protection module 84 is connected to the 3.3 VDC switching supply 86. The 3.3 VDC switching supply provides power on line 88 to the logic circuitry of the IP lock module 38.

Figure 5:
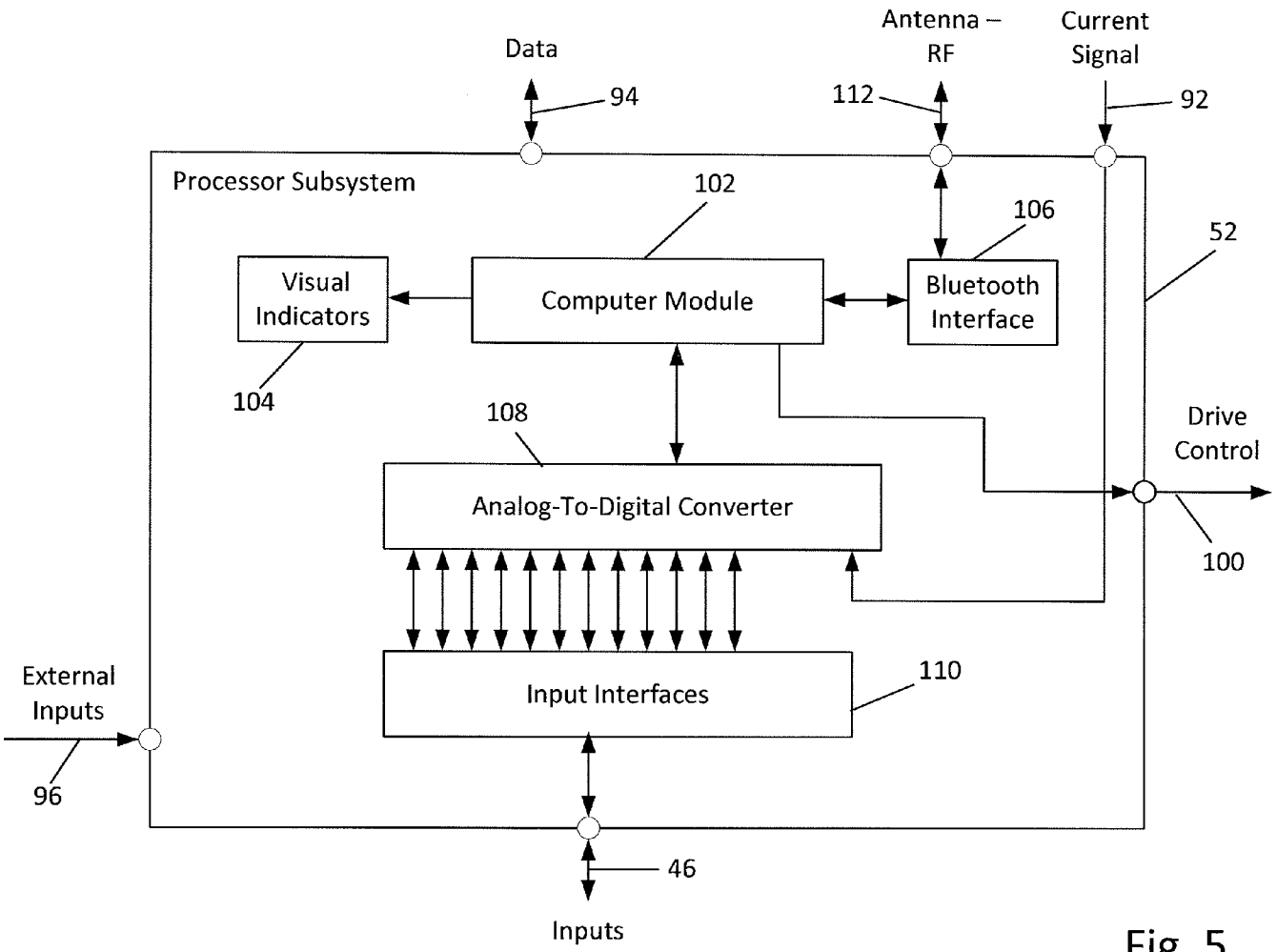
FIG. 5 is a block diagram of a computer module for the lock of the lock system in accordance with the present invention.

Details of the processor subsystem 52 are shown in FIG. 5. The processor subsystem 52 manages and responds to command and configuration messages received from the workstations 16 over the ethernet network 14 and from a Bluetooth interface 106, interprets sensor and switch inputs, displays visual indications, and controls the drive output for the electromechanical components 58. The processor subsystem 52 comprises a computer module 102, visual indicators 104, the Bluetooth interface 106, an analog-to-digital converter 108, and input interfaces 110.

The computer module 102 receives command and configuration data on line 94 sent from the workstations 16 via the ethernet network 14 (FIG. 1) and the magnetics module 74 (FIG. 4). The computer module 102 processes the command and configuration data received from the workstations 16 and generates a signal on line 100 to control the lock drive subsystem 54 that drives the motor 59 and the interlock mechanism 57. The lock drive subsystem 54 connects the 24 VDC on line 98 to the motor 59 and the interlock mechanism 57. Based on commands on line 46 from the processor subsystem 52 to the adapter module 48, the 24 VDC on line 98 drives the motor 59 in one direction to extend the latch bolt and in the opposite direction to retract the latch bolt of the lock 12. The motor 59 may also be a single action motor driving the latch bolt in the first direction to extend the latch bolt. In addition, based on commands on line 46, the 24

VDC on line 98 drives the interlock mechanism 57 to secure the latch bolt in the extended, locked position.

The computer module 102 receives sensor inputs from the lock hardware sensors 34, including the magnetic position sensor 60 and the Hall effect sensor 62, the KOM switch sensor 64, the key switch sensor 66, the latch bolt switch sensor 68, the limit switch sensors 70, and the temperature sensor 72 via the adapter module 48, interconnect cable 46, and input interfaces 110. The computer module 102 also receives external inputs, such as DPS, LEK, and cuff position switch engagements on line 96 via the input interfaces 110. The inputs received at input interfaces 110 are connected to analog-to-digital converter 108, and the digital output of the analog-to-digital converter 108 is connected to the computer module 102 for interpretation and processing.

The processor subsystem 52 includes visual indicators 104 that provide a visual indication of status of each lock 12. The visual indicators comprise two LEDs that that are mounted on the outside of the lock 12 and are controlled by the computer module 102. A green colored LED indicates that the lock is secure, and a red colored LED indicates that the lock is unsecured. In that way personnel can easily determine the status of the lock. A third LED with an amber color may be used to indicate that the lock is in transition from locked to unlocked or from unlocked to locked.

The Bluetooth module 106 provides an alternative system of monitoring and controlling an individual lock 12 within Bluetooth range of a mobile device (not shown) with Bluetooth capability. The mobile device operates as a workstation 16 when connected to the IP lock module 38 of the individual lock 12 by means of the antenna 44, Bluetooth input 112, and the Bluetooth module 106. The Bluetooth module 106 connects the Bluetooth capable mobile device directly to the computer module 102. After determining that the mobile device is authorized to connect to the computer module 102, based on security measures, the mobile device can monitor and control the operation of the individual lock 12 that is in Bluetooth range of the mobile device.

Figure 6:
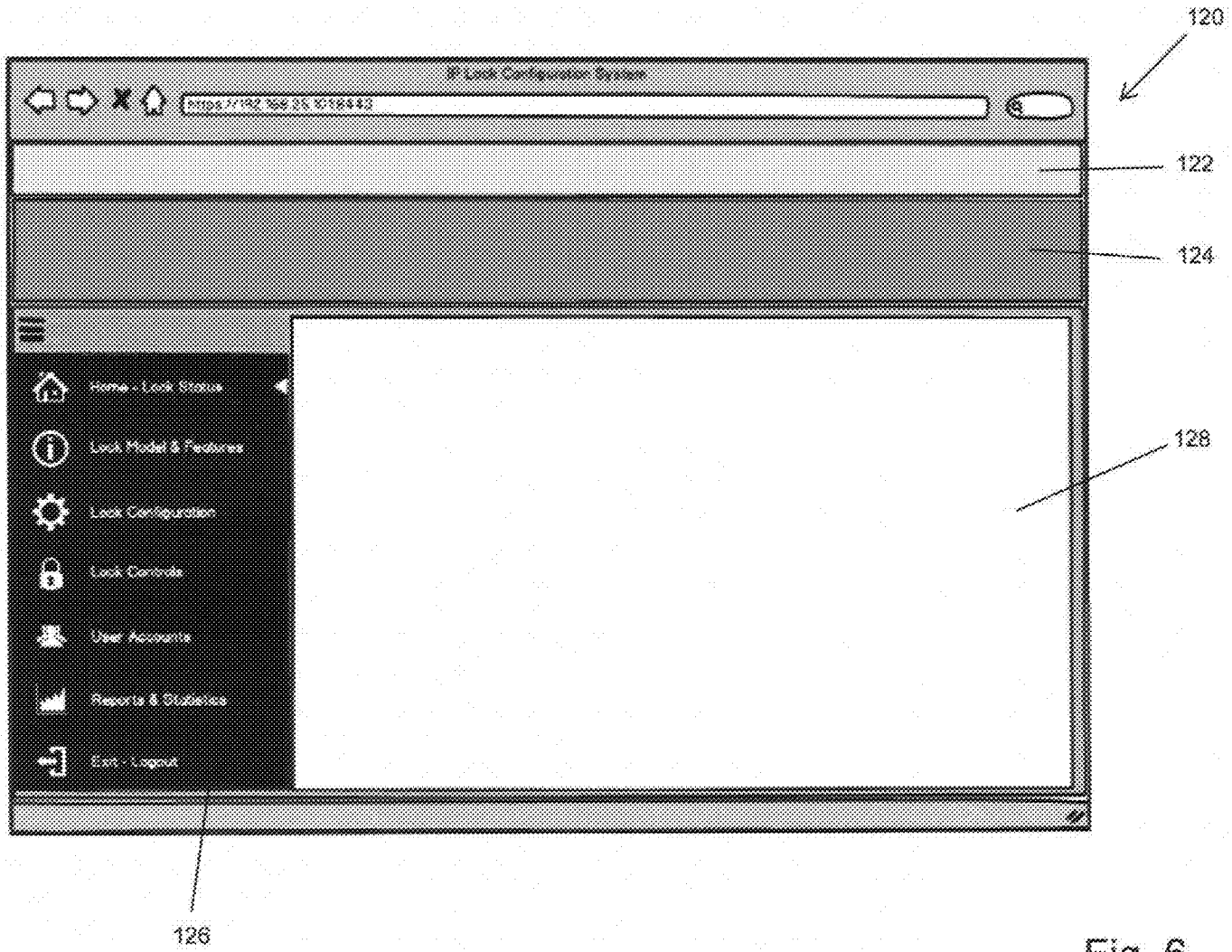
FIG. 6 is a screen template for a workstation of the lock system in accordance with the present invention.

The lock configuration tool 32 and presentation layer/browser 42 retrieve and display a browser page from the server component 22. The browser page is based on a template 120 with the format shown in FIG. 6 for workstations 16 with full-size displays. The template 120 has a notification area 122, an alarms area 124, a navigation area 126, and a main display area 128. Adjustments for smaller screens, such as smart phones, string the areas identified above along the long dimension of the smaller screen.

Figure 7:
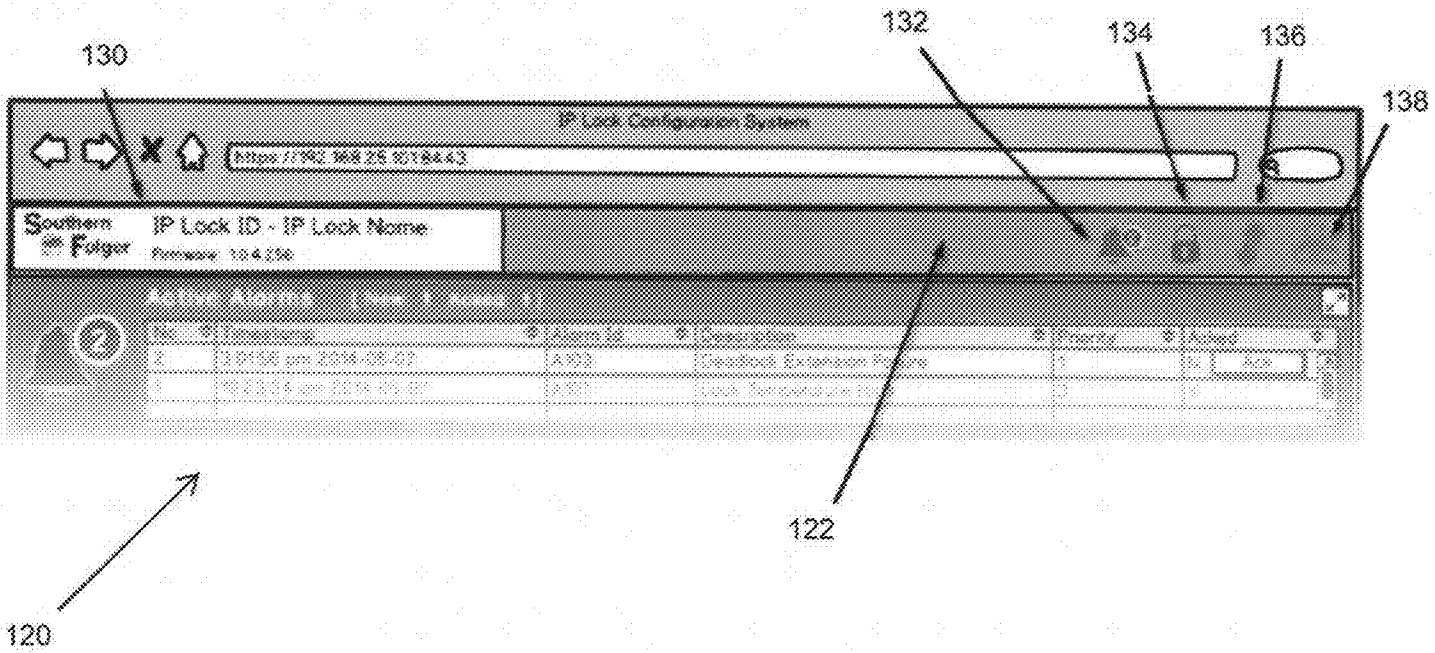
FIG. 7 is screen shot from a workstation showing a lock notification area in the screen template in accordance with the present invention.

The notification area 122 provides quick and informative details about the lock 12 and its status when the user logs into the lock configuration tool 32. The notification area 122 is updated regularly to inform the user of current information and events. FIG. 7 shows an illustrative notification area 122 with a quick lock detail area 130, an active alarm indicator icon 132, a lock unsecured indicator icon 134, an ONVIF enabled indicator icon 136, and a network indicator icon 138. The quick lock detail area 130, for example, displays information about the lock identifier, lock name, and lock firmware version that were configured during the initial setup of the lock 12. The active alarm indicator icon 132 indicates a problem with the lock that requires attention and action on the part of the user. Such a problem may include, for example, lock malfunction or lost ONVIF connection. The lock unsecured indicator icon 132 gives a quick visualization of whether the lock is locked or unlocked depending on both the configuration of the icon 132 and its color. Because the Hall effect sensor 62 can determine not only whether the lock is locked or unlocked but can also determine the transition position and direction of travel of the latch bolt, the icon 132 can display multiple colors and configurations showing that the lock is in transition from locked to unlocked or in transition from unlocked to locked. Also, the configuration of the icon 132 and the color of the icon 132 can indicate whether the interlock mechanism 57 has secured the latch bolt in its extended and locked position. Further, the configuration and color of the icon 132 can be changed in order to indicate that the lock has been unlocked for a predetermined time. The configuration and color of the icon 132 can also communicate that the lock is subject to maintenance. The ONVIF enabled indicator icon 136 communicates to the user which features are enabled. For example, the icon 136 tells the user whether Bluetooth or ONVIF are enabled. The network indicator icon 138 tells the user the operating status of the ethernet network 14. The notification area 122 can also provide noncritical messages to inform the user of upcoming scheduled maintenance or if a lock is currently undergoing maintenance.

Figure 8:
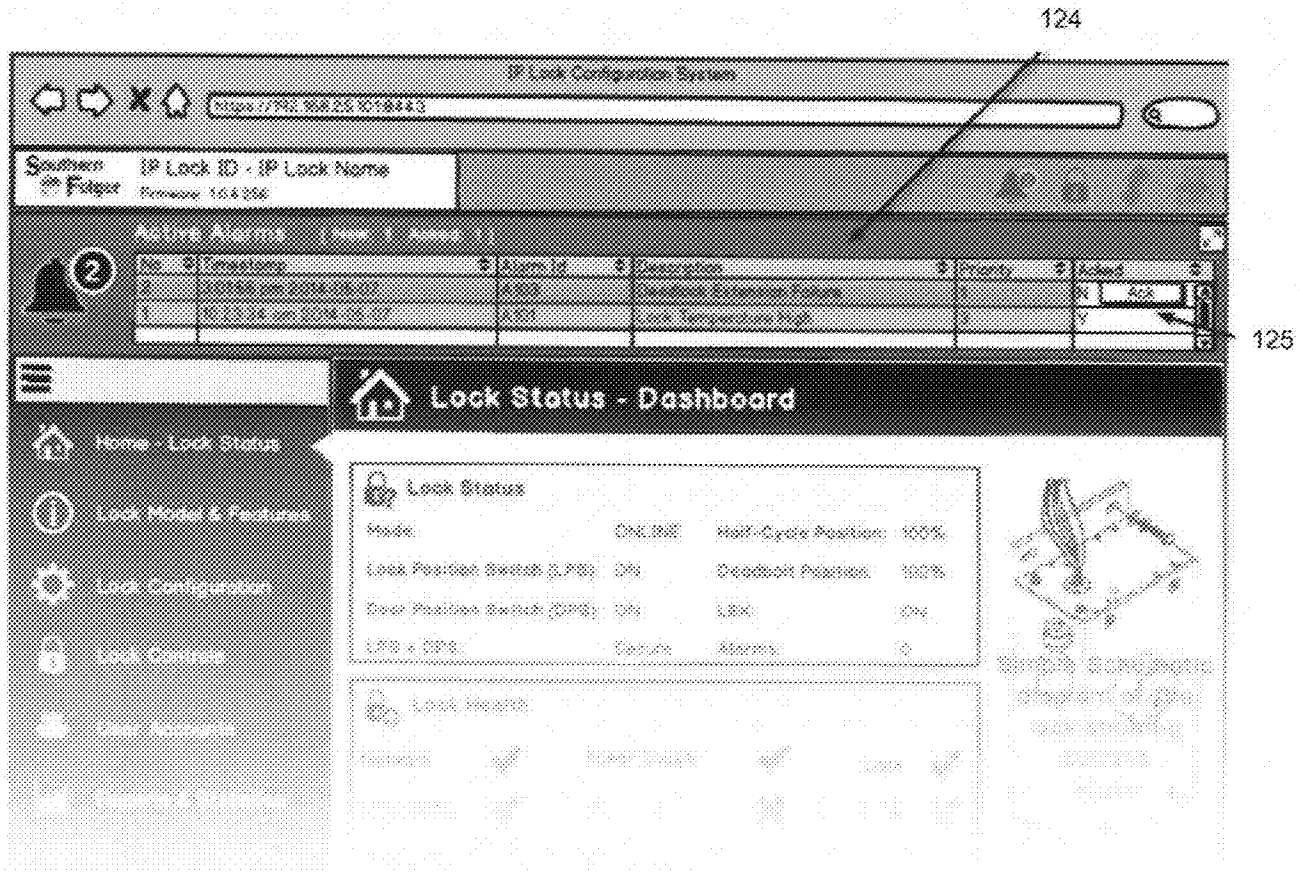
FIG. 8 is screen shot from a workstation showing an alarms area in the screen template in accordance with the present invention.

The alarm reporting area 124 includes alarms reported by the locks 12. The alarms are displayed in a data table. The alarms are displayed in order of importance based on priority levels assigned to each alarm. FIG. 8 shows an illustrative display for the alarm reporting area 124. Each entry in the table in the alarm reporting area 124 includes an identification of the alarm, a timestamp for the alarm, a description of the alarm, the priority for the alarm, and whether the users at workstations 16 have acknowledged the existence of the alarm 125. A typical alarm is triggered when a lock attribute value exceeds a predetermined limit such as an over temperature condition sensed by temperature sensor 72 (FIG. 3). Lock alarms have several levels of priority depending on the severity the problem. If the lock's latch bolt fails to extend to and lock in the secured position, such a condition would represent a high priority alarm requiring immediate attention. Colors are also associated with the alarms in the data table in the alarm reporting area 124 as quick visual cues about the severity of the alarm.

When an alarm occurs, the lock configuration tool 32 requires the alarm to be acknowledged by a user of one of the workstations 16. The action of acknowledging an alarm by a user indicates that someone is aware of the alarm. Acknowledgment, however, does not clear the alarm, and the status of the lock 12 will not go back to normal, pre-alarm status as a result of acknowledgment. Acknowledgment simply means that corrective action is required at some time to resolve the problem. In some cases, the IP lock module 38 may clear an alarm, even without any external intervention, but acknowledgment requires user action.

As an example, a high or medium priority alarm usually requires immediate user action and must be acknowledged promptly. Very low-priority alarms may not require immediate acknowledgment. For alarm conditions that may resolve themselves (for example, the lock's temperature rises too high but then becomes lower again), the alarm remains as unresolved until the user acknowledges the alarm.

There are three (3) main groups of alarms that are managed by the lock module 38. These groups are:

- Lock Hardware Alarms: Generated when a problem is identified with the operation of the electromechanical components 58 or sensors 34 of the lock 12.
- IP Lock Module Alarms: Generated when a problem is identified with the internal circuitry such as ethernet, Bluetooth, power supply, etc. managed by the IP lock module 38.

Lock Services Alarms: Generated when a problem is identified with services managed by the IP lock module 38, for example the server 26 of a lock 12 is not running.

With continuing reference to FIG. 8, the user uses the lock configuration tool 32 to acknowledge alarms by clicking on the "Ack" button associated with the alarm in the data table in the alarm area 124. When the "Ack" button is clicked, an "Acknowledgment Alarm" window appears providing a summary of the alarm. A notes section of the window allows the user to capture information about the pending alarm, how the alarm was resolved, or required course of action. The acknowledgement window may also include problem resolution guidelines or checklist for the user.

In order to log into a workstation 16 and to access browser pages generated by the server component 22 of the remote lock system 10, a user must pass two levels of security. The first level of security is the secure connection established between the browser 42 and the browser page generated by the server 26. The server 26 on the lock 12 is configured for Secure-HTTP (Https) using OpenSSL. OpenSSL is an open source security software program commonly used with Apache servers such as server 26. The OpenSSL provides robust, commercial-grade, and full-featured toolkit for developing secure server sites using the SSL/TLS protocols.

When the user enters the special secure-HTTP URL in the browser, "https://<IP Address of lock>", a security certificate created with OpenSSL by the server 26 is provided to the browser 42. This SSL certificate enables the browser 42 and server 26 to build a secure and encrypted connection through a process called "handshake", where public and private keys are exchanged between the server 26 and browser 42 to confirm their identity. If connection is successful, a "padlock" icon in the notification area 122 of the screen template 120 and the "https://" prefix in the URL are the visible indications of a secure session in progress.

The second level of security is user authentication. The login browser page requires the user to enter a username and password that are assigned by the system administrator. Once the user enters his or her credentials (username and password), the server 26 determines whether this user should be able to have access to the browser pages generated by the server 26. Each user is assigned a role or profile that defines what the user can see and use within the lock configuration tool 32. Each user given access to the lock configuration tool 32 is assigned a specific user profile or role by the system administrator. Examples of user roles are as follows:

Administrator: Full access to the lock configuration tool functions (menus and browser pages)

Maintenance: Limited access to the lock configuration tool's maintenance-related menus (upgrade firmware, save configuration data, acknowledge alarms, etc.)

User with Report View-Only: Access to the lock configuration tool "Reports and Statistics" menu (described below) with limited access to view the history and alarms history of the lock but no access to maintenance menu options.

Figure 9:
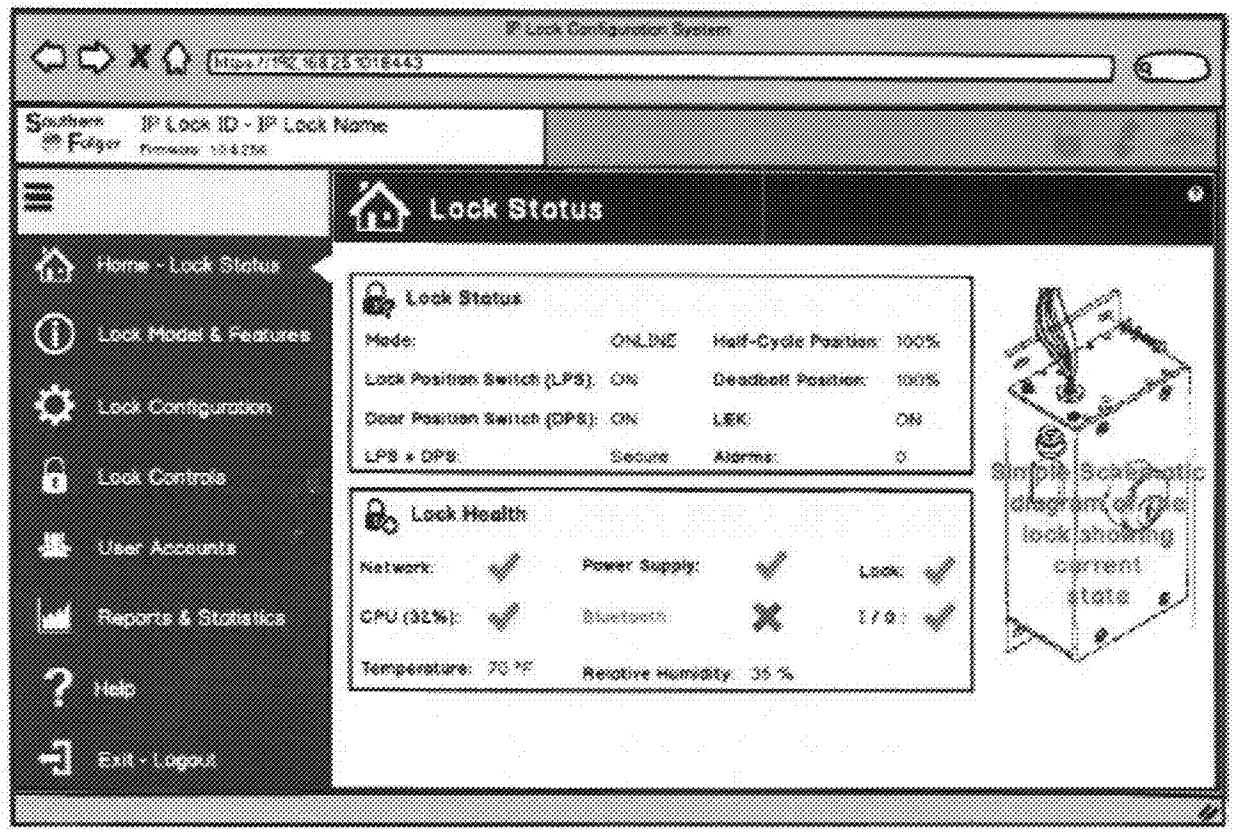
FIG. 9 is screen shot from a workstation showing a home screen in accordance with the present invention.

When the server 26 has validated the username and password, the authorized user is presented with a "Home" screen. FIG. 9 shows an example of the home screen. The purpose of the home screen is to provide a quick view to the current status of one of the locks 12.

Figure 10:
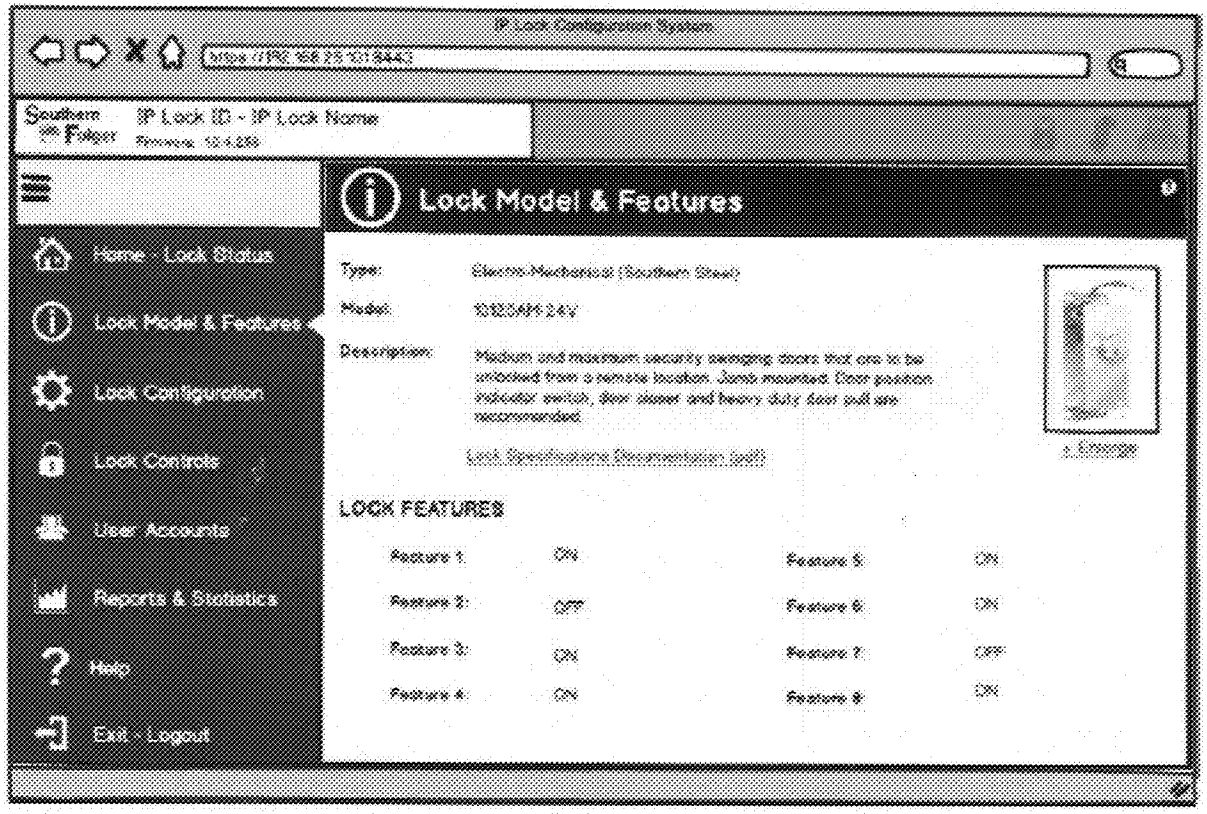
FIG. 10 is screen shot from a workstation showing a lock model and feature screen in accordance with the present invention.

FIG. 10 illustrates the "Lock Model and Features" screen of the presentation layer/browser 42. The browser page displayed on the lock model and features screen provides additional details about the current lock model and its features.

Figure 11:
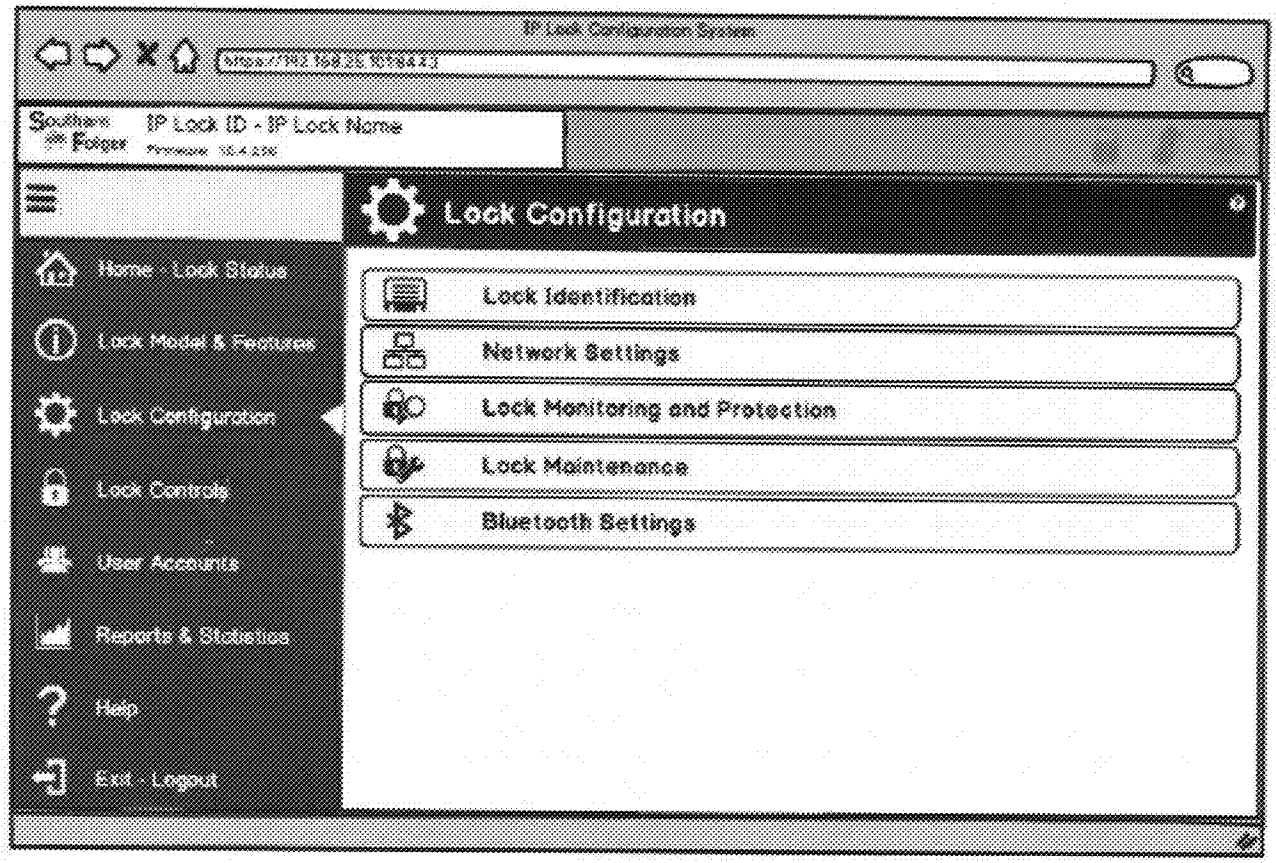
FIG. 11 is screen shot from a workstation showing a top-level lock configuration screen in accordance with the present invention.
Figure 12:
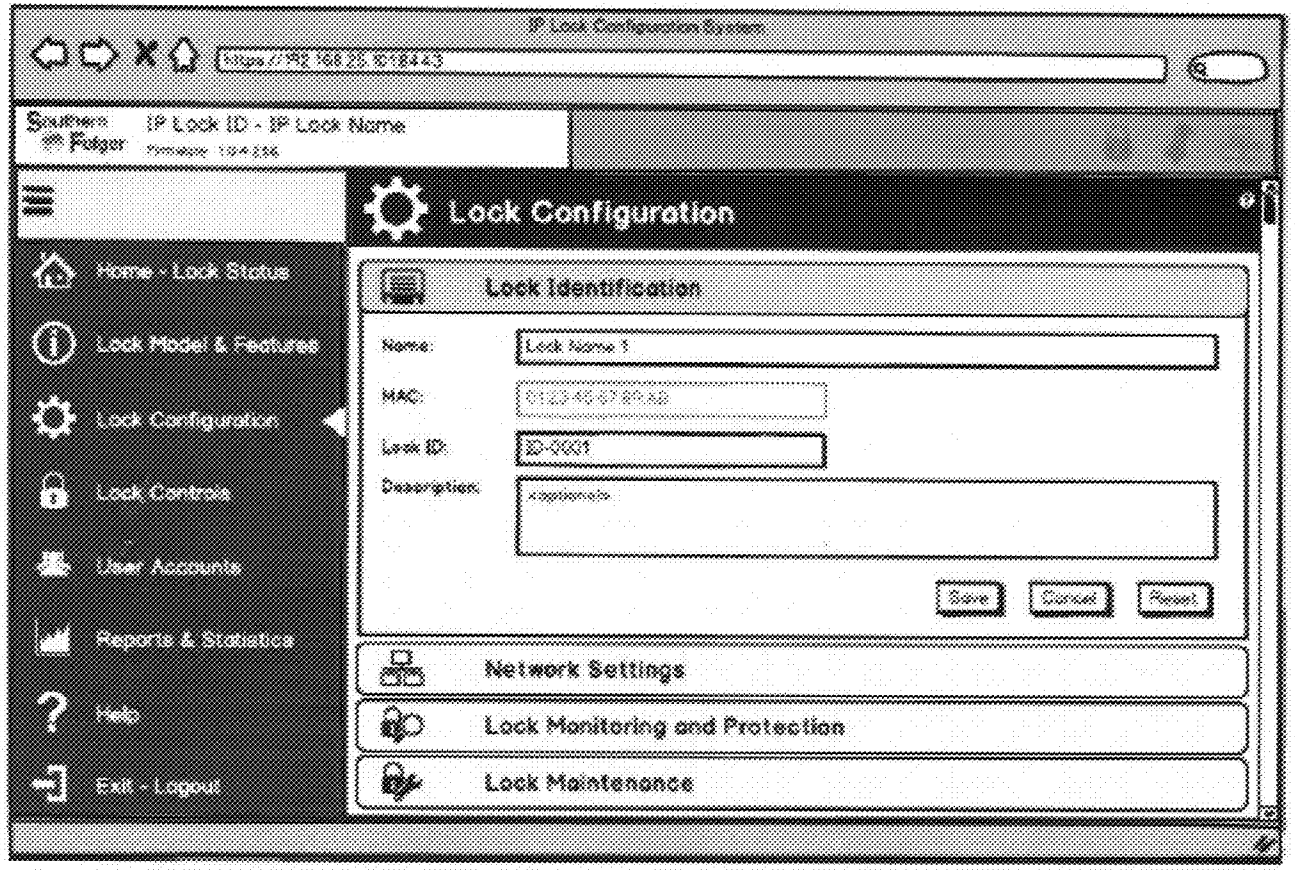
FIG. 12 is screen shot from a workstation showing a lock identification screen of the lock configuration in accordance with the present invention.

FIG. 11 illustrates the "Lock Configuration" screen. The lock configuration screen is a high-level menu which shows the various sub menu items used to display and configure the various lock attributes:

Lock Identification sub menu (FIG. 12): Used to assign lock name, description, and unique identifier.

Figure 13:
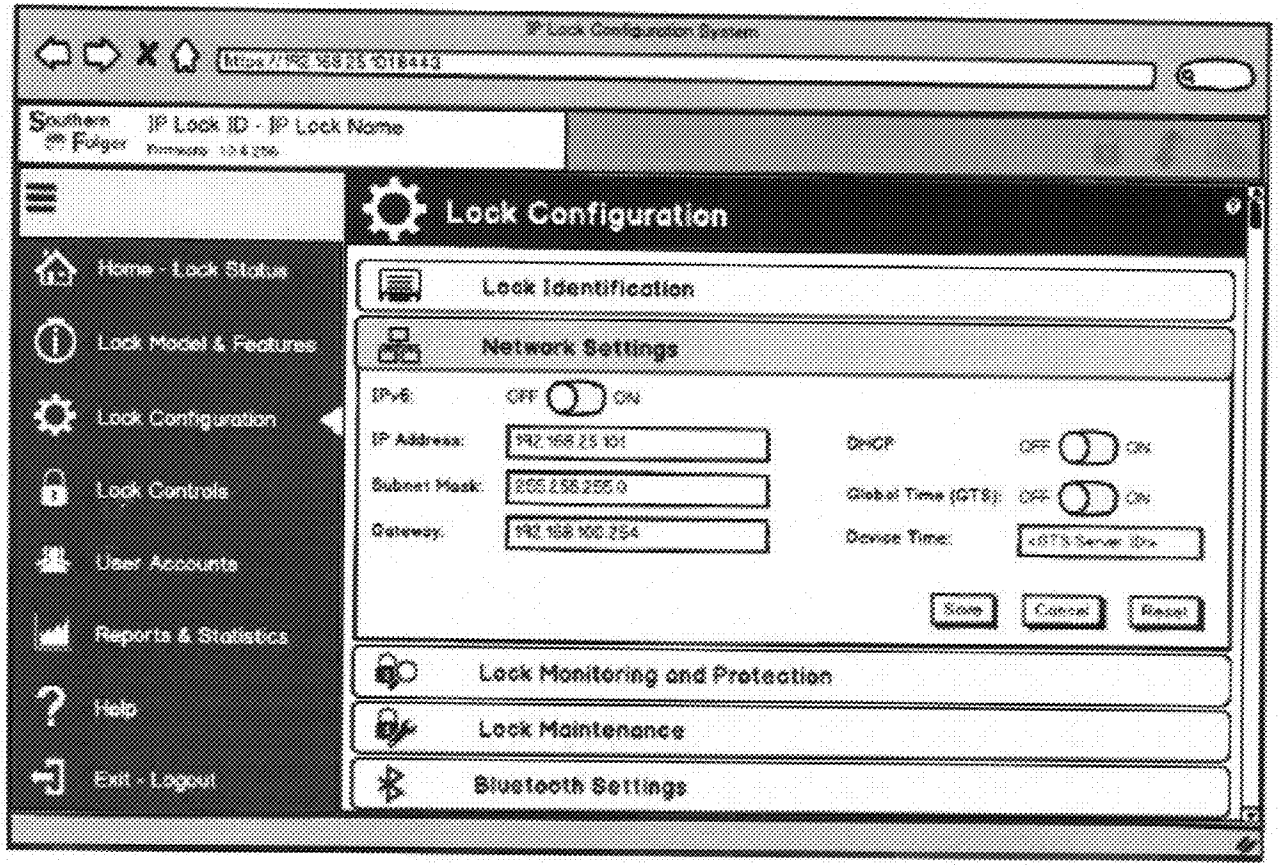
FIG. 13 is screen shot from a workstation showing a network settings screen of the lock configuration in accordance with the present invention.
Figure 14:
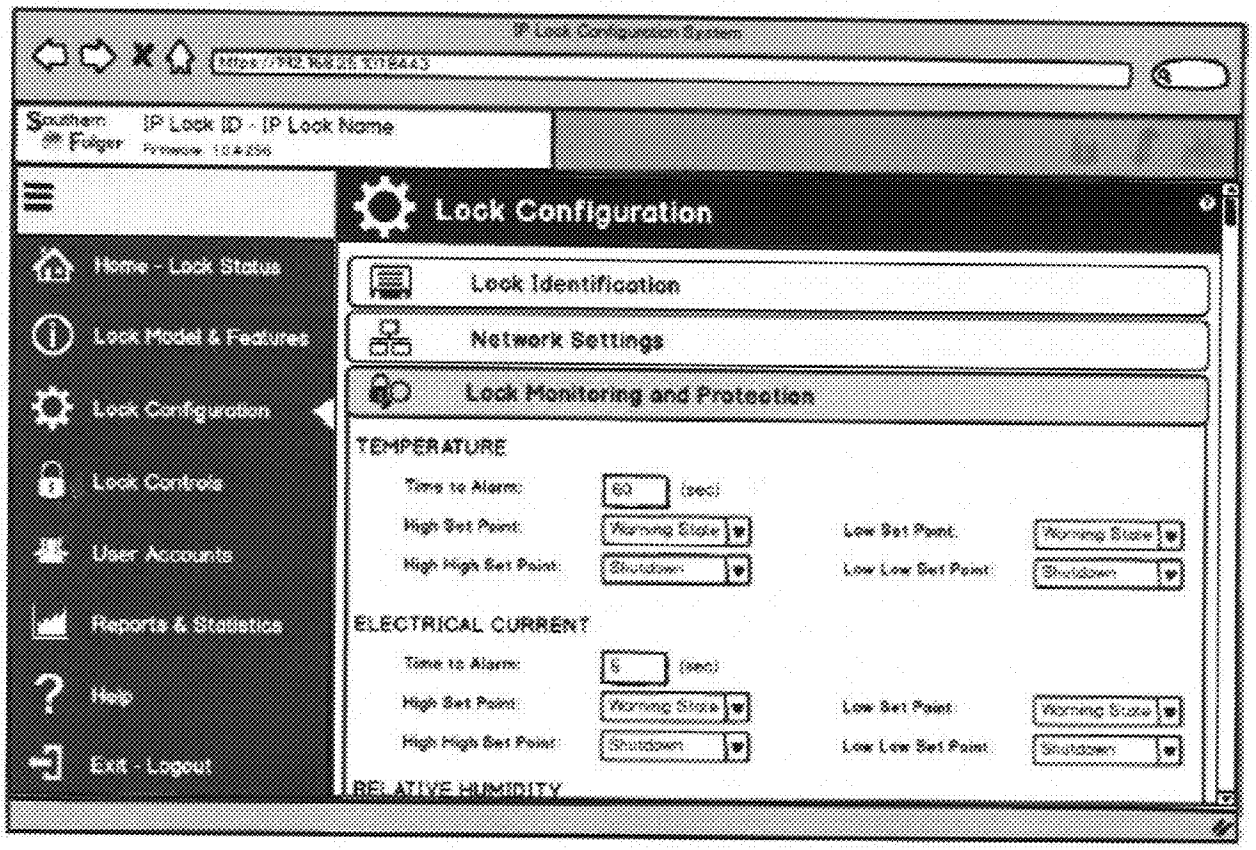
FIG. 14 is screen shot from a workstation showing a lock monitoring and protection screen of the lock configuration in accordance with the present invention.

Network Settings sub menu (FIG. 13): Used to control various network settings such as the IP address of the lock, Bluetooth activation, etc Lock Monitoring and Protection sub menu: Used to set temperature, relative humidity, and electrical current alarm notification settings.

Figure 15:
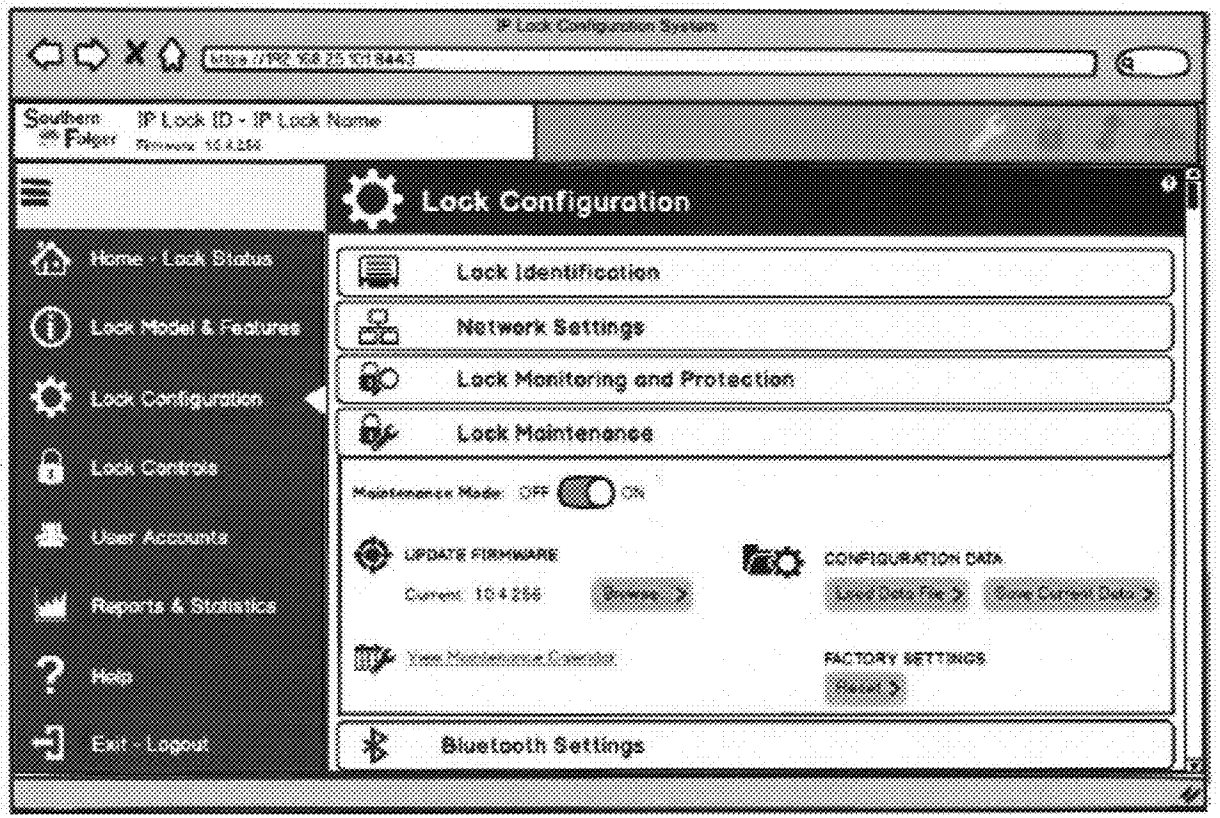
FIG. 15 is screen shot from a workstation showing a lock maintenance screen of the lock configuration in accordance with the present invention.

Lock Maintenance sub menu (FIG. 15): Used to perform various maintenance activities on the lock such as installing new firmware, restarting the lock, resetting the lock to factory settings, uploading a configuration file, or using another configuration file previous stored on the lock. This menu is only available to a user with the appropriate role privileges.

Bluetooth Settings sub menu: Used to enable or disable the Bluetooth antenna. The Bluetooth settings sub menu may be used to commission the IP lock (first-time use) and may also include future features such as "Man Down" or "Guard Tour".

Figure 16:
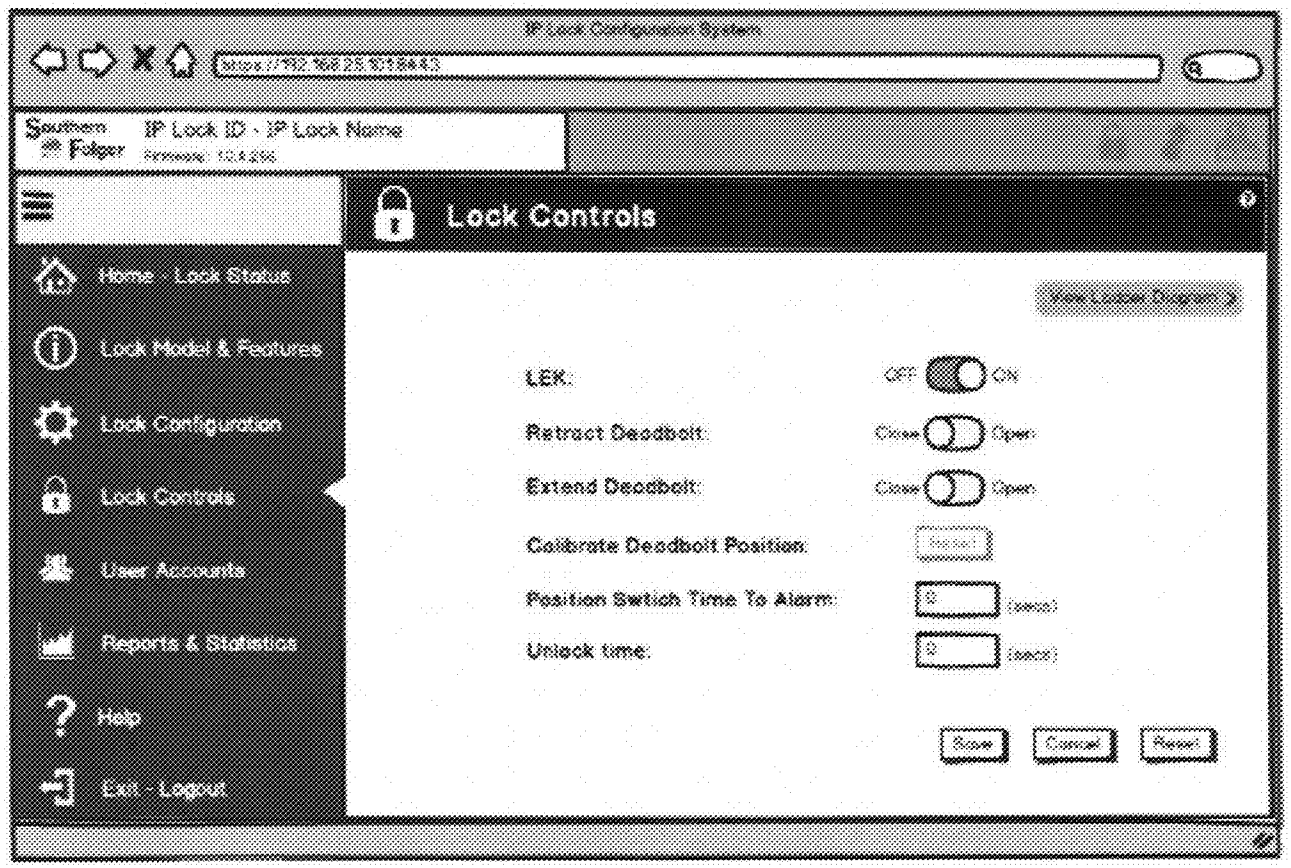
FIG. 16 is screen shot from a workstation showing a lock controls screen in accordance with the present invention.

FIG. 16 illustrates an example of a lock control screen, which allows the user to control the lock 12 such as retracting or extending the latch bolt and setting other control attributes. The lock control screen allows the user to view the lock's ladder (circuit and relay diagram). The ladder diagram may be dynamic where changes in relay values are shown in color. By using the lock control screen, the user can change relay values directly on the diagram to modify the functionality and performance of the lock 12.

Figure 17:
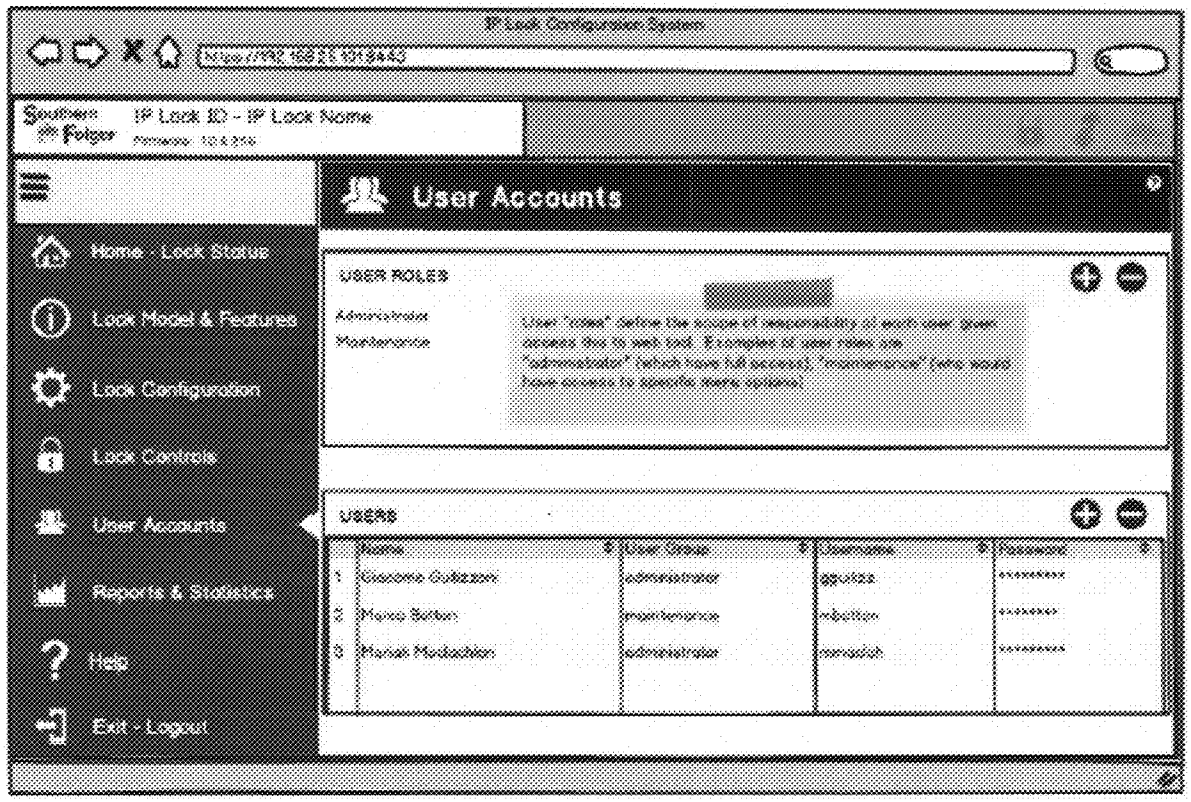
FIG. 17 is screen shot from a workstation showing a user accounts screen in accordance with the present invention.

FIG. 17 illustrates an example of a user account screen that identifies the account users and the role assigned to particular users. As previously described, a user has access to browser pages or portions of browser pages based on the user's assigned role. For example, if the user has a low access assigned role, the browser pages will be automatically modified to show only the information to which that particular user is entitled.

Figure 18:
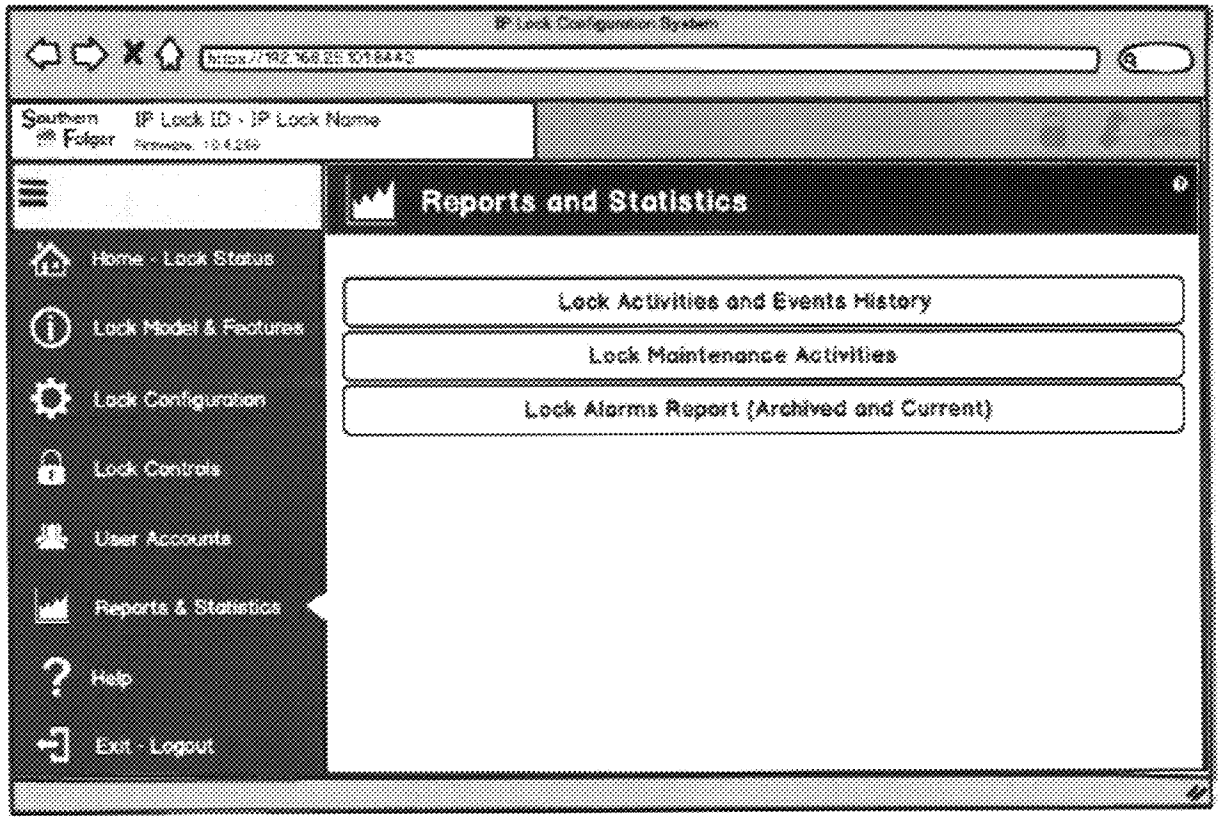
FIG. 18 is screen shot from a workstation showing a top-level reports and statistics screen in accordance with the present invention.

FIG. 18 illustrates an example of a reports and statistics screen. The reports and statistics screen offers the user a selection of reports such as a lock activities and events history report, a lock maintenance activities report, or a lock alarms report (archived and current). Again, depending on the user's assigned role, the reports available will be either limited or redacted for the particular user.

Having thus described exemplary embodiments, it should be noted by those skilled in the art that the within disclosures are exemplary only and that various other alternatives, adaptations, and modifications may be made within the scope of this disclosure as described herein and as described in the appended claims.

What is claimed is:

1. A remote lock system comprising:

a. a lock having an electromechanical component for operating the lock and at least one sensor for sensing the status of the lock;

b. a server component associated with and integral with the lock, the server component comprising:

i. a data layer including a data layer API for receiving data from the sensor relating to the status of the electromechanical component of the lock and for transmitting commands to the electromechanical component to control the operation of the electromechanical component; and ii. a network application logic layer for invoking the data layer API for receiving the data relating to the status of the lock from the data layer and transmitting commands to the data layer to control the operation of the electromechanical component of the lock; and c. a client component:

i. for receiving data relating to status of the electromechanical component over a network to which the server component and the client component are connected;

ii. for displaying the status of the lock; and iii. for sending commands to the lock, wherein the data layer and the network application logic layer are configured so that the data layer API is not exposed to the client component connected to the network.

2. The remote lock system of claim 1, wherein the client component comprises a workstation for a user including:

a. a lock configuration tool for receiving the data over the network relating to the status of the lock and for sending commands over the network to control the operation of the lock, and b. a presentation layer connected to the lock configuration tool for displaying the data to the user relating to the status of the lock and for creating the commands by the user for controlling the operation of the lock.

3. The remote lock system of claim 1, wherein the lock further includes an IP lock module integral with the lock and having a processor subsystem that receives data relating to the status of the sensor from the sensor, processes the data, and transmits data over the network to the client component and wherein the processor subsystem receives commands from the client component over the network, processes the commands, and controls the operation the electromechanical component.

4. The remote lock system of claim 3, wherein the network is an ethernet network and the IP lock module and the electromechanical component are powered by current supplied over the ethernet network.

5. The remote lock system of claim 3, wherein the IP lock module of the lock further includes an antenna and an RF interface connected to the antenna for sending and receiving local RF signals from a local workstation within RF range of the antenna and wherein the local workstation receives data relating to the status of the lock and sends commands via the RF interface to control the operation of the lock.

6. The remote lock system of claim 1, wherein the remote lock system includes a plurality of locks connected to the network.

* * * * *